US009976555B2

(12) United States Patent
Cheng

(10) Patent No.: US 9,976,555 B2
(45) Date of Patent: May 22, 2018

(54) CONTROL METHOD AND CONTROL SYSTEM FOR SCREW PUMP

(71) Applicant: DELTA ELECTRONICS, INC., Taoyuan Hsien (TW)

(72) Inventor: Lon-Jay Cheng, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 462 days.

(21) Appl. No.: 14/706,791

(22) Filed: May 7, 2015

(65) Prior Publication Data

US 2016/0115959 A1 Apr. 28, 2016

Related U.S. Application Data

(60) Provisional application No. 62/067,820, filed on Oct. 23, 2014.

(30) Foreign Application Priority Data

Apr. 9, 2015 (TW) ..... 104111502 A

(51) Int. Cl.
*F04C 13/00* (2006.01)
*E21B 43/12* (2006.01)
(Continued)

(52) U.S. Cl.
CPC ..... *F04C 13/008* (2013.01); *E21B 43/121* (2013.01); *E21B 43/126* (2013.01); *F04C 2/1071* (2013.01); *F04C 14/28* (2013.01); *F04C 2240/403* (2013.01); *F04C 2270/035* (2013.01); *F04C 2270/075* (2013.01); *F04C 2270/72* (2013.01)

(58) Field of Classification Search
CPC .. F04C 13/008; F04C 2270/72; E21B 43/121; E21B 43/126
See application file for complete search history.

(56) References Cited

U.S. PATENT DOCUMENTS 5,883,489 A * 3/1999 Konrad ..... F04D 15/0066 318/805
5,941,305 A * 8/1999 Thrasher ..... E21B 43/121 166/53
(Continued)

FOREIGN PATENT DOCUMENTS

TW 201018075 A 5/2010

*Primary Examiner* — Peter J Bertheaud
(74) *Attorney, Agent, or Firm* — Kirton McConkie; Evan R. Witt

(57) ABSTRACT

A control method is used with a control system to control a screw pump. The control system includes an electric motor and a motor drive. The control method includes following steps. Firstly, a DC bus voltage is monitored. If the DC bus voltage is smaller than a first threshold value, a potential energy stored in the pump screw and released by a backspin action is converted into a regenerative electrical energy so as to maintain a normal operation of the motor drive. Then, the motor drive drives the electric motor to control the backspin action of the screw pump according to a backspin torque limit strategy. If the electrical power from the power source is not restored and the level of a reverse regenerative torque is smaller than a preset torque value, the backspin action of the screw pump is stopped freely.

11 Claims, 8 Drawing Sheets

(51) Int. Cl.
*F04C 2/107* (2006.01)
*F04C 14/28* (2006.01)

(56) References Cited

U.S. PATENT DOCUMENTS 5,996,691 A * 12/1999 Norris ..... E21B 43/121
166/250.03
7,330,779 B2 * 2/2008 Schulz ..... E21B 41/0021
417/44.11
7,437,215 B2 * 10/2008 Anderson ..... E21B 41/0021
417/44.11
7,534,096 B2 * 5/2009 Schulz ..... E21B 41/0021
417/44.11
8,287,246 B2 * 10/2012 Plitt ..... F04B 47/06
318/10
8,334,666 B2 * 12/2012 Plitt ..... E21B 47/0007
318/255
9,140,253 B2 * 9/2015 Wentworth ..... F04B 47/02

* cited by examiner

CONTROL METHOD AND CONTROL SYSTEM FOR SCREW PUMP

CROSS-REFERENCE TO RELATED APPLICATION

This application claims the benefit of U.S. Provisional Application No. 62/067,820 filed on Oct. 23, 2014, and entitled "SYSTEM AND METHOD FOR CONTROLLING OPERATION OF SCREW PUMP TO ELIMINATE THE EFFECTS OF BACKSPIN WHEN ELECTRICAL POWER IS LOST", the entirety of which is hereby incorporated by reference.

FIELD OF THE INVENTION

The present invention relates to a control method and a control system, and more particularly to a control method and a control system for a screw pump.

BACKGROUND OF THE INVENTION

Screw pumps (also referred to as progressive cavity pumps) are widely used in the oil industry to pump oil from wells. Generally, the operations of the screw pump are controlled by a pump control system including an electric motor and a motor drive. The screw pump comprises a pump rod having a stator and a rotor. The pump rod of the screw pump is physically located deep within the oil well for pumping the oil to the surface. The geometry of the assembly of the stator and the rotor constitutes two or more series of spiral and separate cavities. The electric motor is configured to rotate the rotor of the screw pump. When the rotor rotates inside the stator, the cavities move spirally from one end of the stator to the other and a positive displacement pumping action is created so as to lift the oil to the surface.

When the screw pump is in normal pumping operation, the screw pump driven by the electric motor can provide energy to wind up the pump rod so as to lift the oil to the surface. One of the more significant problems encountered with the pumping operation of the screw pump is the "backspin" that may occur in the event of a momentary electrical power interruption. When the electrical power is lost, the screw pump loses the ability to control the energy stored in the pump rod due to the oil load thereon. However, since a very large amount of stored energy still exists in the pump rod of the screw pump, the action of the screw pump is similar to a wound coil spring. The stored energy is released through backspin of the pump rod of the screw pump, causing the rotor of the screw pump to rotate in the opposite direction. The pump rod of the screw pump will spin in the reverse direction until all the oil has fallen back down the production tube and the oil level in the production tube and the well are equal due to gravity. Depending on the pump applications, the backspin time of the screw pump can last for several hours. Under this circumstance, the pumping operation of the screw pump cannot be restarted immediately when the electrical power is provided again. The time period spent during backspin and the time period of waiting for the oil to get back to the ground level (after restarting) will lose productivity. Consequently, electrical power interruption can cause a significant loss in screw pump productivity.

In addition, when the motor drive is shut down by a user, the pump operation of the screw pump is decelerated and stopped by a barking device according to a scheduled shut down procedure. When the motor drive stops providing the control voltage to the electric motor and the electric motor is shut off, the stored energy is released through backspin of the pump rod of the screw pump at very high backspin speeds. Since the driving mechanism of the electric motor is often directly connected to the rotor of the screw pump, the electric motor will be subjected to backspin. Uncontrolled backspin can severely damage the drive mechanism and other production equipment. In some instances, the backspin may result in equipment destruction. In addition, if such destruction occurs at the ground level of the well, there exists the possibility of personal injury and environmental contamination.

Therefore, there is a need of providing a control method and a control system for controlling the operation of a screw pump to eliminate the effects of backspin when electrical power is lost so as to obviate the drawbacks encountered from the prior arts.

SUMMARY OF THE INVENTION

An object of the present invention provides a control method and a control system for a screw pump. When the electrical power is lost, the control system can maintain the operations of the motor drive and the electric motor to control the backspin of the screw pump by using the regenerated electrical power, which is converted from the stored potential energy released by the backspin action of the pump rod. The time period of stopping the screw pump is shortened by using a braking unit and a braking resistor of a brake device to release the excess stored potential energy. Consequently, when electrical power is lost, the effects of backspin that occur in the conventional control system will be avoided. That is, the possibility of resulting in equipment destruction of the drive mechanism and other production equipment will be minimized, and the personal safety, environment cleanliness and the productivity of the screw pump will be enhanced.

In accordance with an aspect of the present invention, there is provided a control method for use with a control system to control a screw pump. The control system includes an electric motor and a motor drive. The electric motor is synchronously rotated with the screw pump. The motor drive controls an operation of the electric motor. The motor drive includes a DC/AC converter for converting a DC bus voltage into a driving voltage so as to drive the electric motor. The DC bus voltage is obtained by converting an electrical power from a power source. The control method includes the following steps. Firstly, in a step (a), the DC bus voltage is monitored. Then, a step (b) is performed to judge whether the DC bus voltage is smaller than a first threshold value. If a judging result of the step (b) indicates that the DC bus voltage is smaller than the first threshold value, a step (c) is performed. Then, in a step (c), a potential energy stored in the pump screw and released by a backspin action is converted into a regenerative electrical energy, and the regenerative electrical energy is provided to the motor drive to maintain a normal operation of the motor drive. Then, in a step (d), the motor drive drives the electric motor to control the backspin action of the screw pump according to a backspin torque limit strategy. In a step (e), the DC bus voltage is limited to be larger than a second threshold value. Then, a step (f) is performed to judge whether the electrical power from the power source is restored. In a step (g), if a judging result of the step (f) indicates that the electrical power from the power source is not restored, a level of a reverse regenerative torque is monitored. Then, a step (h) is performed to judge whether the level of the reverse regenerative torque is smaller than a preset torque value. In a step (i), if a judging result of the step (h) indicates that the level of the reverse regenerative torque is smaller than the preset torque value, the backspin action of the screw pump is stopped freely.

In accordance with another aspect of the present invention, there is provided a control system for controlling a screw pump. The control system includes an electric motor and a motor drive. The electric motor is synchronously rotated with the screw pump. The motor drive is electrically connected with a power source. The motor drive includes a DC/AC converter and a controlling unit. The DC/AC converter is electrically connected with the electric motor for converting a DC bus voltage into a driving voltage so as to drive the electric motor. The DC bus voltage is obtained by converting an electrical power from the power source. The controlling unit is electrically connected with the DC/AC converter for controlling the DC/AC converter and monitoring the DC bus voltage. If the electrical power from the power source is interrupted and the controlling unit judges that the DC bus voltage is smaller than a first threshold value, a potential energy stored in the pump screw and released by a backspin action is converted into a regenerative electrical energy to provide the motor drive, and the backspin action of the screw pump is controlled according to a backspin torque limit strategy.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
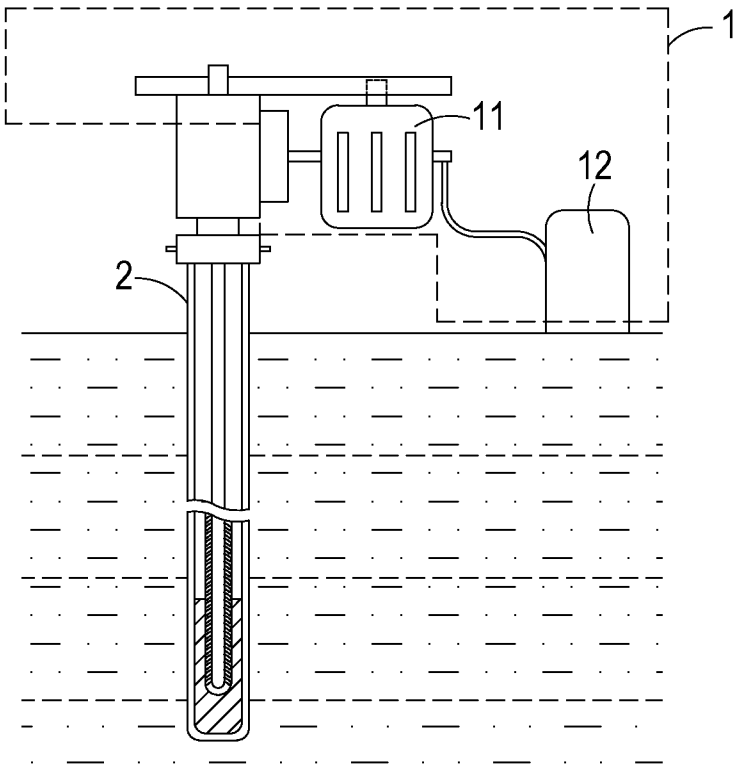
FIG. 1 is a simplified schematic view of a control system for a screw pump according to an embodiment of the present invention.
Figure 2:
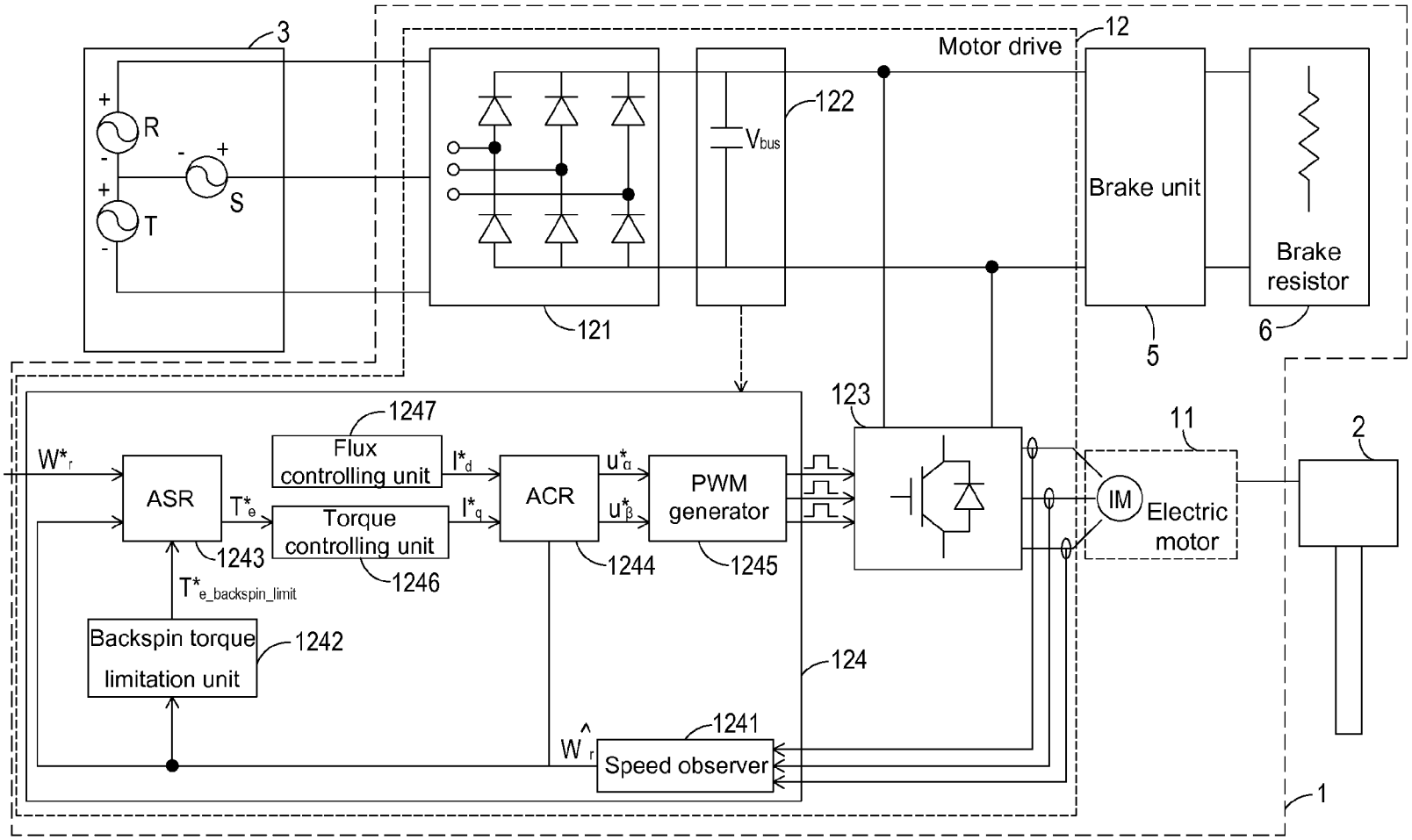
FIG. 2 is a schematic circuit block diagram of the control system of FIG. 1.

FIG. 1 is a simplified schematic view of a control system for a screw pump according to an embodiment of the present invention. FIG. 2 is a schematic circuit block diagram of the control system of FIG. 1. As shown in FIGS. 1 and 2, the control system 1 is configured to control and drive the pumping operation of a screw pump 2 for pumping oil from an oil well to a ground level. The structures of the screw pump 2 are similar to those of the conventional screw pump, and are not redundantly described herein. Moreover, the control system 1 comprises an electric motor 11, a motor drive 12 and a brake device. The electric motor 11 is electrically with a rotor of a pump rod of the screw pump 2 and synchronously rotated with the screw pump 2. Moreover, the electric motor 11 is configured to drive and rotate the rotor of the screw pump 2 for pumping the oil from the oil well to the ground level. Preferably, the electric motor 11 is an induction motor. The brake device comprises a brake unit 5 and a brake resistor 6. The brake unit 5 is electrically connected between the motor drive 12 and the brake resistor 6. The brake unit 5 is used for controlling the action of the brake resistor 6 and allowing the brake resistor 6 to release or consume energy.

The motor drive 12 is electrically connected with a power source 3 (i.e. three-phase power source) and the electric motor 11 for controlling the operation of the electric motor 11. Preferably but not exclusively, the motor drive 12 comprises an AC/DC converter 121, a DC link 122 (e.g., a DC bus), a DC/AC converter 123 and a controlling unit 124. In an embodiment, the AC/DC converter 121 is a three-phase rectifier including a plurality of diodes. The input terminal of the AC/DC converter 121 is electrically connected with the power source 3. The AC/DC converter 121 receives an AC voltage (e.g., a three-phase AC voltage) from the power source 3 and converts the AC voltage into a DC voltage. The DC link 122 is a capacitor. The DC link 122 is electrically connected to the output terminal of the AC/DC converter 121. By the DC link 122, the DC voltage from the AC/DC converter 121 is stabilized and filtered, and thus a DC bus voltage $V_{bus}$ is generated. The DC/AC converter 123 is a three-phase inverter including one or more insulated gate bipolar transistors (IGBTs). The DC/AC converter 123 is electrically connected with DC link 122 and the electric motor 11. The DC/AC converter 123 receives the DC bus voltage $V_{bus}$ and converts the DC bus voltage $V_{bus}$ into a driving voltage in order for driving the electric motor 11. An example of the controlling unit 124 includes but is not limited to a digital signal processor (DSP). The controlling unit 124 is electrically connected with the DC/AC converter 123 and the DC link 122 for controlling the operations of the insulated gate bipolar transistors (IGBTs) of the DC/AC converter 123 and monitoring the DC bus voltage $V_{bus}$. In an embodiment, the motor driver 12 employs the pulse width modulation (PWM) technology to change the frequency and amplitude of the driving voltage outputted from the DC/AC converter 123 in order for controlling the rotation speed of the electric motor 11. When the frequency of the driving voltage is increased, the electric motor 11 is accelerated. Meanwhile, the electrical energy is transferred from the power source 3 to the electric motor 11 through the motor driver 12 so as to provide required energy for driving the electric motor 11. Preferably, the motor drive 12 is a variable frequency drive or a variable speed drive, which can control the motor speed and torque of the electric motor 11 by varying the frequency and amplitude of the driving voltage of the electric motor 11.

In this embodiment, the controlling unit 124 includes a speed observer 1241, a backspin torque limitation unit 1242, a speed control circuit 1243 (ASR), a current control circuit 1244 (ACR), a PWM generator 1245, a torque controlling unit 1246 and a flux controlling unit 1247. The structures and operations of the speed control circuit 1243 (ASR), the current control circuit 1244 (ACR), the PWM generator 1245, the torque controlling unit 1246 and the flux controlling unit 1247 are well known to those skilled in the art, and are not redundantly described herein. In this embodiment, the speed observer 1241 is electrically connected with the electric motor 11 for estimating the rotation speed of the rotor of the electric motor 11, thereby generating a rotation speed estimation value $\hat{W}_r$. The backspin torque limitation unit 1242 is configured to store a backspin torque limit strategy. Moreover, the backspin torque limitation unit 1242 is electrically connected with the speed observer 1241 for providing torque limitation $T^*_{e_backspin_limit}$ according to the rotation speed estimation value $\hat{W}_r$ from the speed observer 1241. The speed control circuit 1243 is electrically connected with the backspin torque limitation unit 1242. Moreover, the speed control circuit 1243 is configured to receive a rotation speed command $W^*_r$ and the torque limitation $T^*_{e_backspin_limit}$ from the backspin torque limitation unit 1242 and providing a torque command $T^*_e$ according to the rotation speed command $W^*_r$ and the torque limitation $T^*_{e_backspin_limit}$. The torque controlling unit 1246 is connected with the speed control circuit 1243 and configured to receive the torque command $T^*_e$ and convert the torque command $T^*_e$ into a Q-axis current command $I^*_q$. The flux controlling unit 1247 is configured to generate a D-axis current command $I^*_d$. The current control circuit 1244 is electrically connected with the torque controlling unit 1246 and the flux controlling unit 1247. According to the Q-axis current command $I^*_q$ from the torque controlling unit 1246 and the D-axis current command $I^*_d$ form the flux controlling unit 1247, the current control circuit 1244 generates an alpha current command $u^*_\alpha$ and a beta current command $u^*_\beta$ to the PWM generator 1245. The PWM generator 1245 is electrically connected with the current control circuit 1244 and the DC/AC converter 123. According to the alpha current command $u^*_\alpha$ and the beta current command $u^*_\beta$, the PWM generator 1245 generates a PWM signal to control ON/OFF operations of the switching elements (e.g., the IGBTs) of the DC/AC converter 123 so as to drive and control the operations of the electric motor 11 and eliminate the effects of backspin.

When the screw pump 2 is in normal pumping operation, the pump rod of the screw pump 2 is driven by the electric motor 11 to lift the oil from the oil well to the ground level and store potential energy due to the oil load thereon.

Figure 3A:
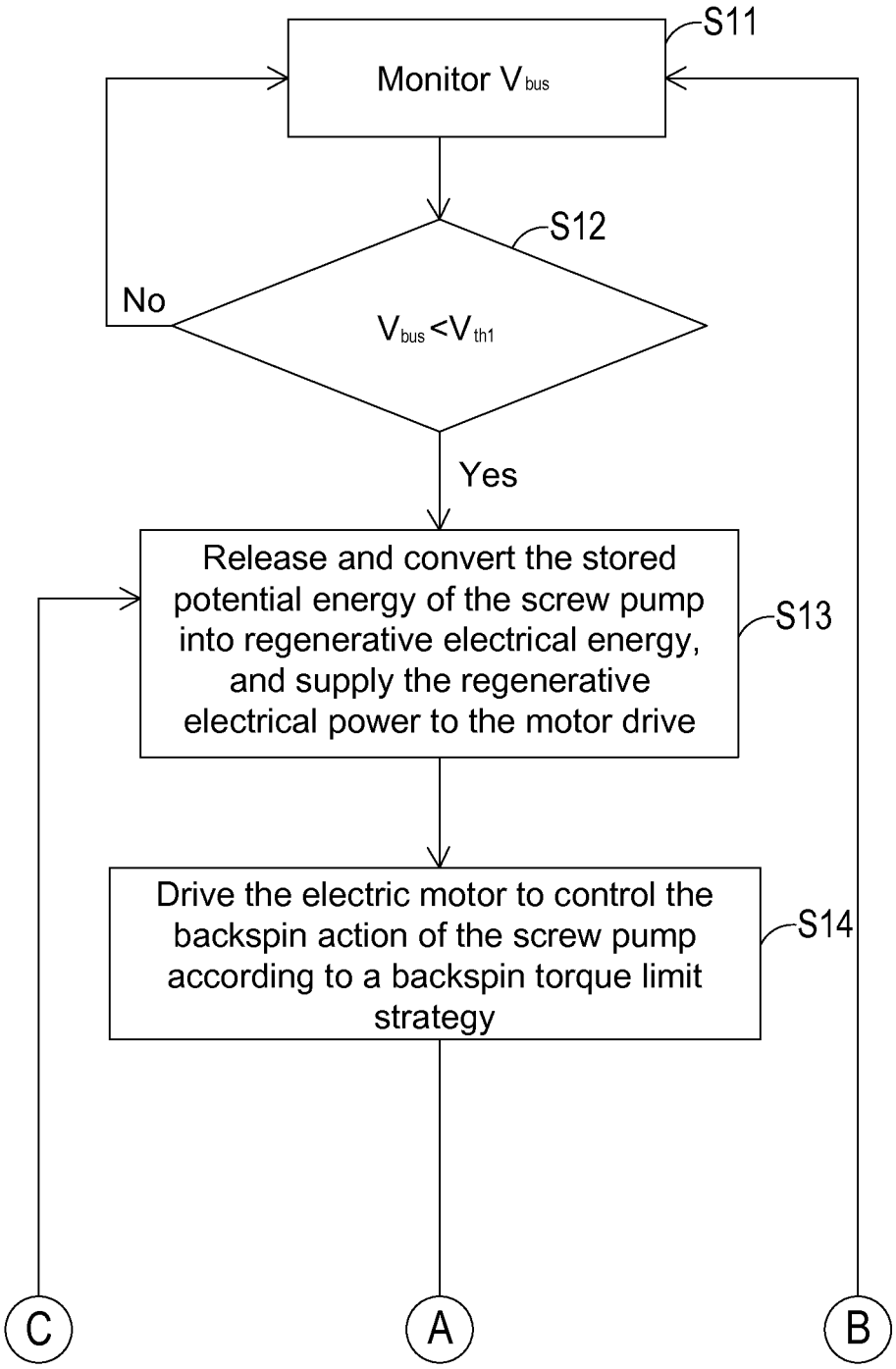
FIGS. 3A and 3B schematically illustrate a flowchart of a control method for a screw pump according to an embodiment of the present invention.
Figure 3B:
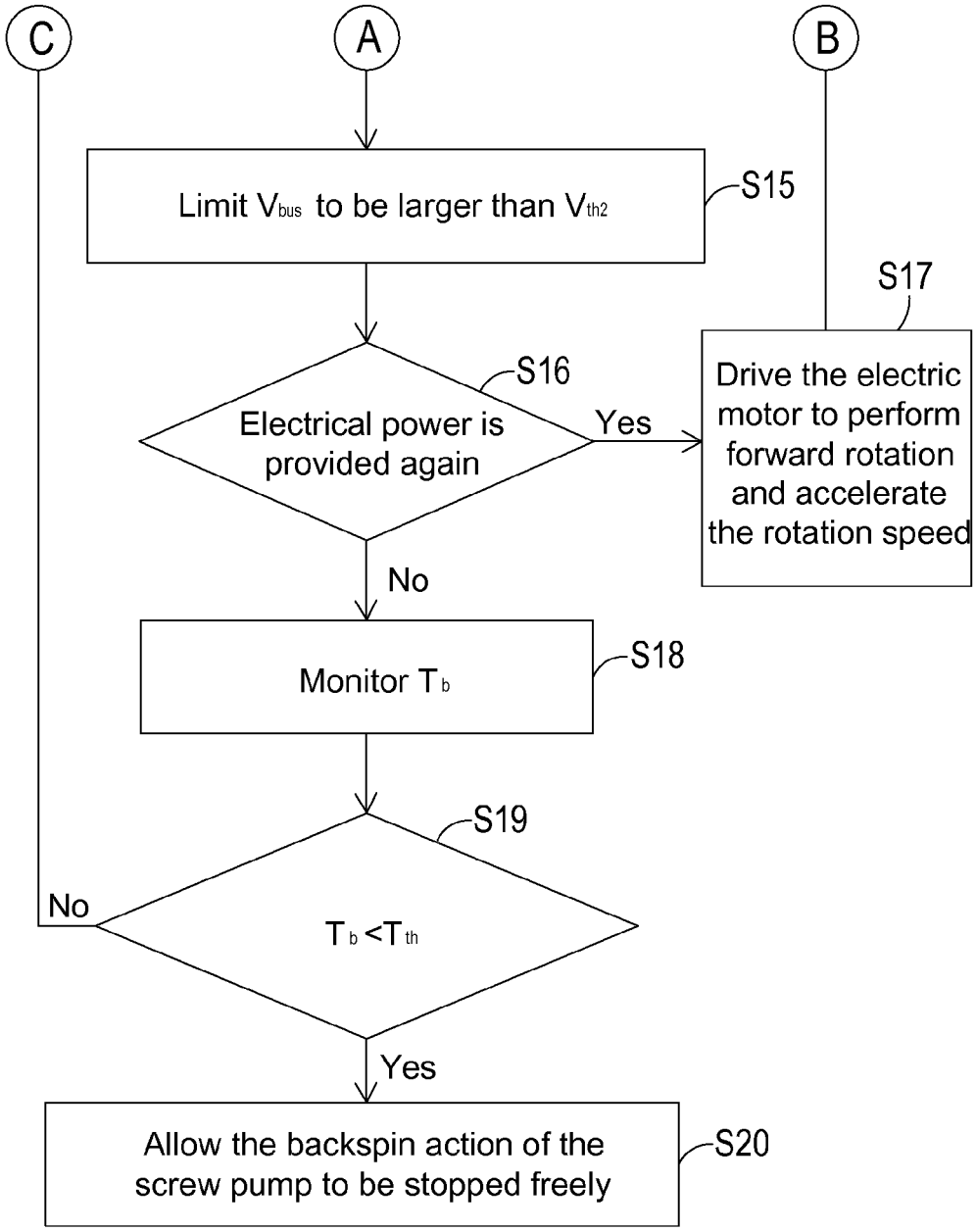
Figure 6:
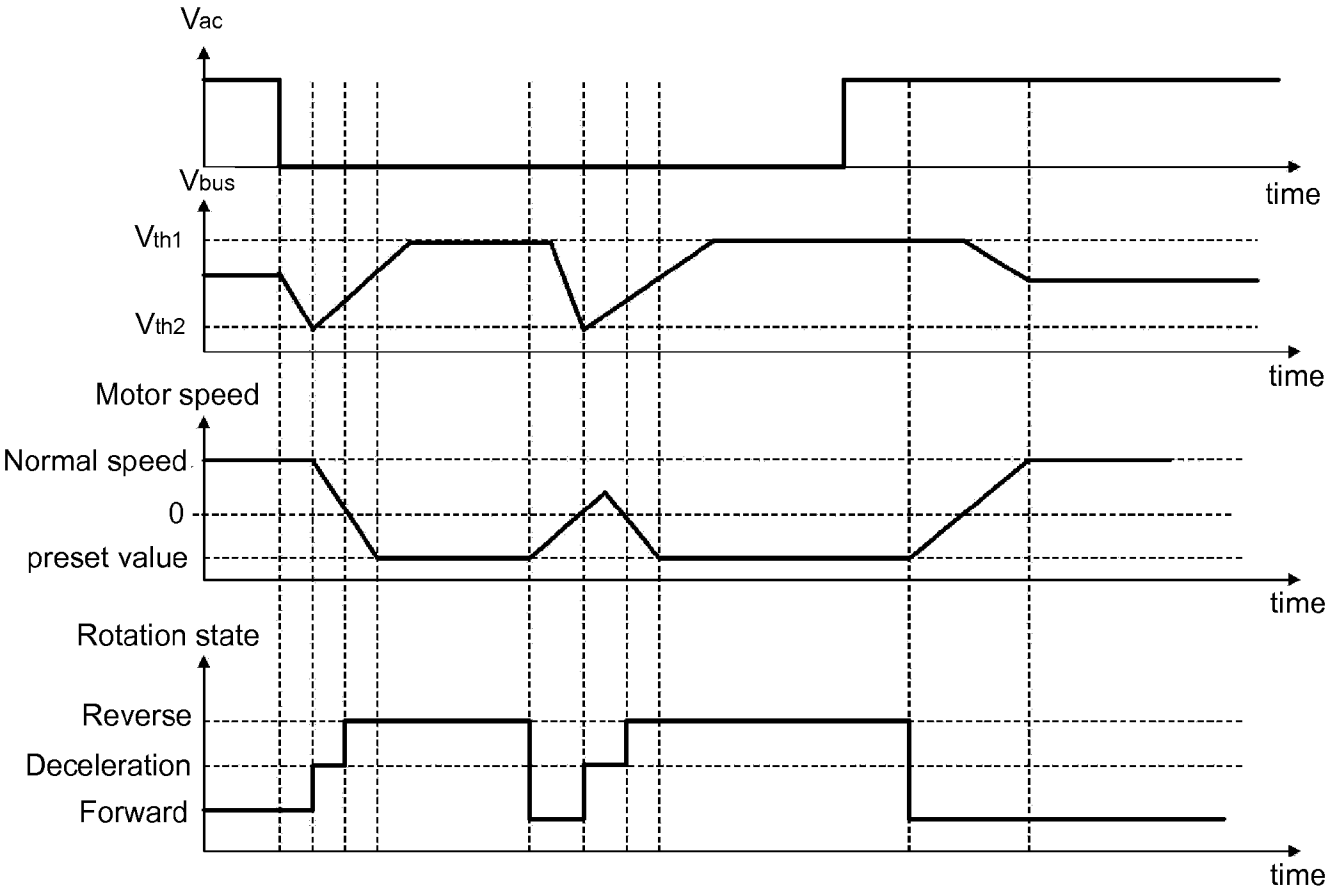
FIG. 6 is a schematic timing waveform diagram illustrating the relationships between the AC voltage, the DC bus voltage, the motor speed and the backspin state signal processed by the control system of the present invention.
Figure 7:
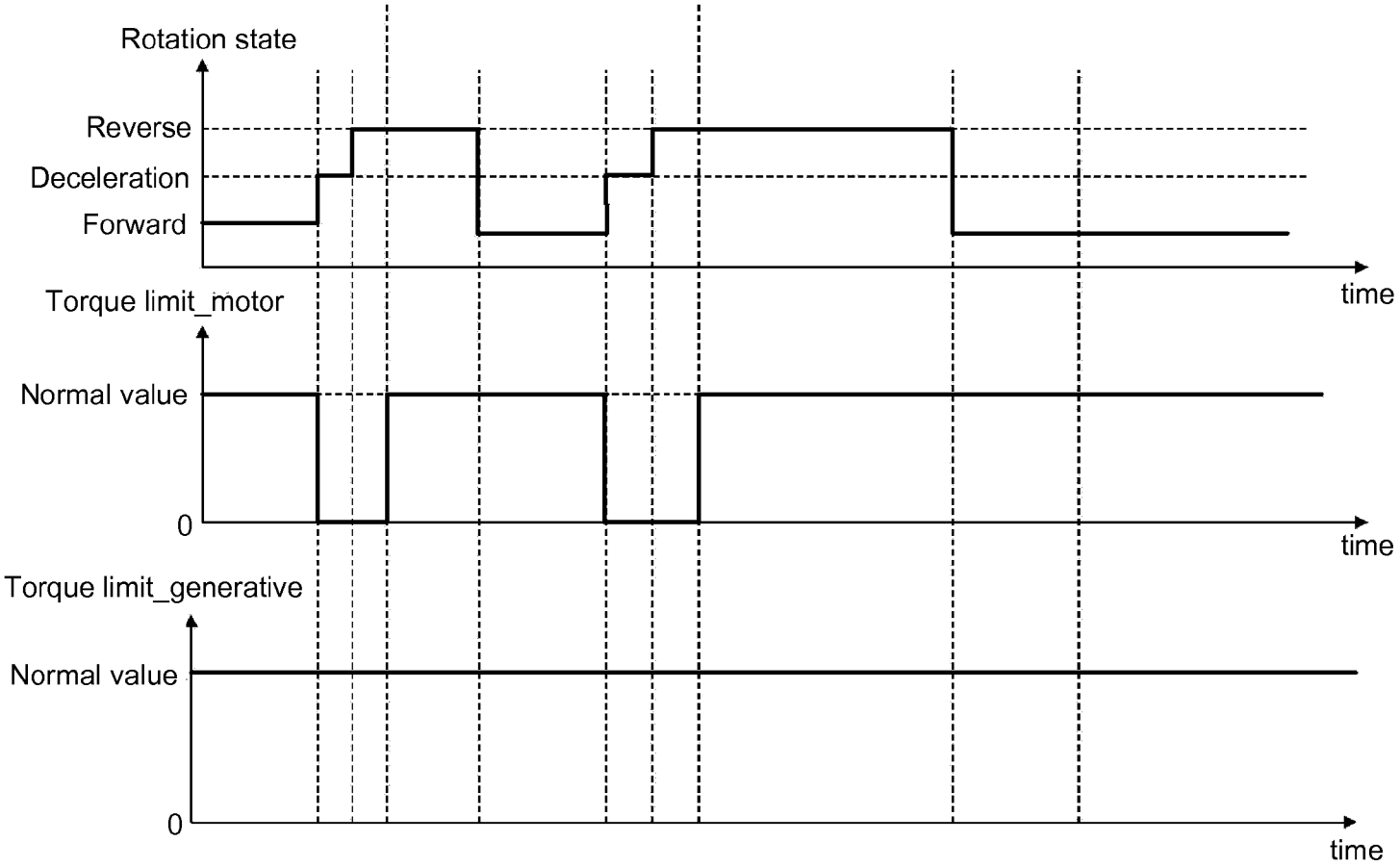
FIG. 7 is a schematic timing waveform diagram illustrating the relationships between the backspin state signal, the motor torque limitation and the generative torque limitation processed by the control system of the present invention.

FIGS. 3A and 3B schematically illustrate a flowchart of a control method for a screw pump according to an embodiment of the present invention. FIG. 6 is a schematic timing waveform diagram illustrating the relationships between the AC voltage, the DC bus voltage, the motor speed and the backspin state signal processed by the control system of FIG. 2. FIG. 7 is a schematic timing waveform diagram illustrating the relationships between the backspin state signal, the motor torque limitation and the generative torque limitation processed by the control system of FIG. 2. Please refer to FIGS. 3A, 3B, 6 and 7. The control method can be applied to the controlling unit 124 of the control system 1. The control method comprises the following steps. Firstly, the controlling unit 124 of the motor drive 12 monitors the DC bus voltage $V_{bus}$ (see the step S11). Then, the controlling unit 124 detects whether the DC bus voltage $V_{bus}$ is smaller than a first threshold value $V_{th1}$ (see the step S12). If the controlling unit 124 detects that the DC bus voltage $V_{bus}$ is larger than or equal to the first threshold value $V_{th1}$, the pump rod of the screw pump 2 is driven by the electric motor 11 continuously and the screw pump 2 is in normal pumping operation. Under this circumstance, the step S11 is repeatedly done, and the controlling unit 124 of the motor drive 12 monitors the DC bus voltage $V_{bus}$ continuously. On the other hand, if the controlling unit 124 detects that the DC bus voltage $V_{bus}$ is smaller than the first threshold value $V_{th1}$, the controlling unit 124 determines that the AC voltage $V_{ac}$ supplied by the power source 3 to energize the DC link 122 is gradually decreased because the electrical power interruption occurs (e.g., power trip $V_{ac}=0$) or the motor drive 12 is shut down in response to a command. Consequently, the step S13 is performed. In the step S13, the pump rod of the pump screw 2 is gradually switched from the normal spin state to a backspin state in response to the oil load on the screw pump 2. At the same time, the potential energy stored in the pump screw 2 is released by the backspin action of the pump rod and further converted into regenerative electrical energy to be supplied to the motor drive 12. Consequently, the normal operations of the motor drive 12 and the electric motor 11 can be maintained. That is, when the electrical power from the power source 3 is lost or when the motor drive 12 is shut down in response to a command, the control system 1 can maintain the operations of the motor drive 12 and the electric motor 11 and further control the backspin of the screw pump 2 by using the regenerative electrical power until all the oil has fallen back down a production tube and the oil level in the production tube and the oil well are equal.

Figure 4:
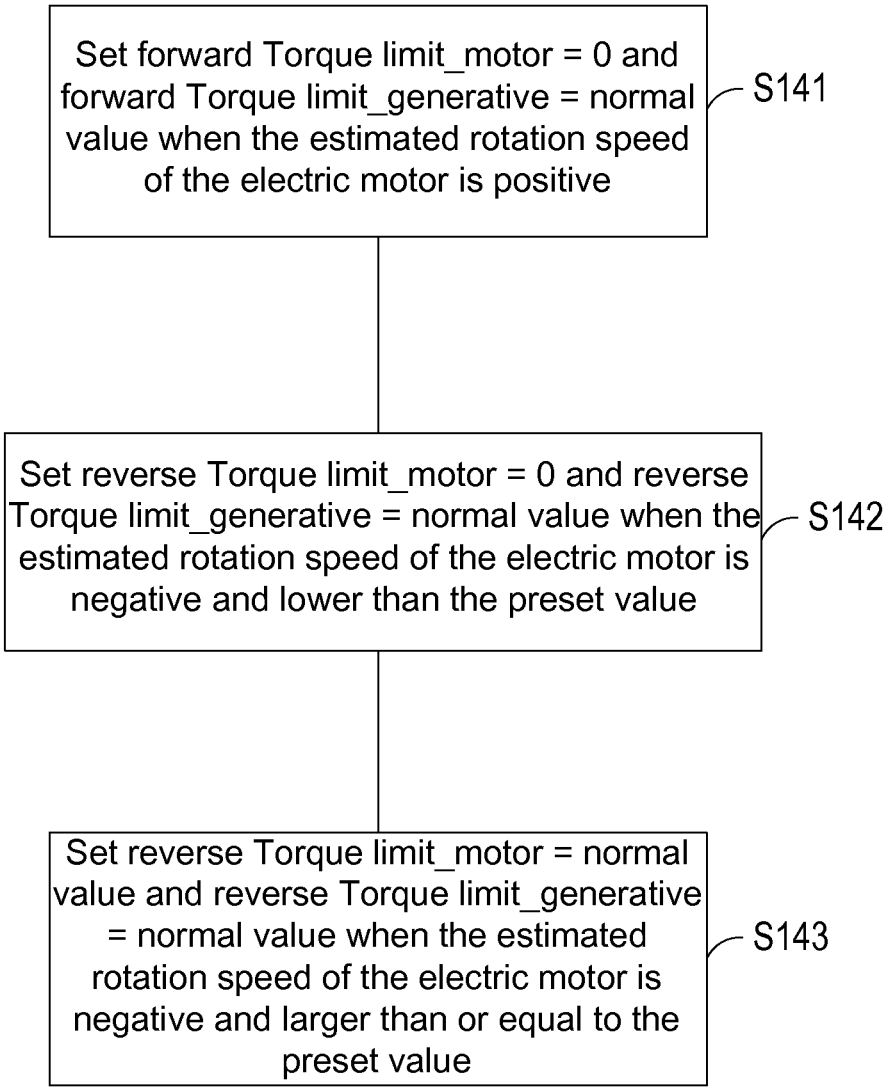
FIG. 4 is a flowchart illustrating the backspin torque limit strategy in the step S14 of FIG. 3A.

After step S13, the motor drive 12 drives the electric motor 11 to control the backspin action of the screw pump 2 according to a backspin torque limit strategy (see the step S14). For example, the rotation speed of the screw pump 2 during the backspin action is controlled. Moreover, the backspin action of the screw pump 2 is the process that the pump screw 2 is gradually switched from the normal spin to the backspin state. FIG. 4 is a flowchart illustrating the backspin torque limit strategy in the step S14 of FIG. 3A. Please refer to FIG. 4. Firstly, the motor rotation speed command $W^*_r$ is set to a negative one. When the rotation speed of the electric motor 11 estimated by the speed observer 1241 is positive, the forward motor torque limitation (Torque limit_motor) is set to zero and the forward regenerative torque limitation (Torque limit_generative) is set to a normal value, which is a multiple of the rated torque (for example 120) (see the step S141). Consequently, during the normal pumping operation of the screw pump 2, the positive rotation speed of the screw pump 2 is gradually decreased, and the stored potential energy released by the screw pump 2 is converted into the regenerative electrical energy. Under this circumstance, the regenerative electrical energy can be transmitted to the DC link 122 of the motor drive 12, and the energy outputted by the motor drive 12 (e.g., the driving voltage) can be reduced. On the other hand, when the rotation speed of the electric motor 11 estimated by the speed observer 1241 is negative and lower than a preset value (i.e., the electric motor 11 is in the backspin state but the rotation speed of the electric motor 11 does not reach the preset value), the reverse motor torque limitation (Torque limit_motor) is set to zero and the reverse regenerative torque limitation (Torque limit_generative) is set to a normal value, which is a multiple of the rated torque (for example 120) (see the step S142). Since the reverse motor torque limitation (Torque limit_motor) is set to zero, the electric motor 11 is not forced to rotate in the reverse direction, but the reverse rotation of the electric motor 11 is freely done because of the gravity of the oil in the screw pump 2. Consequently, during the backspin action of the screw pump 2, the backspin rotation speed of the screw pump 2 is gradually increased, and the stored potential energy in the screw pump 2 is converted into the regenerative electrical energy. When the estimated rotation speed of the electric motor 11 by the speed observer 1241 is negative and larger than or equal to the preset value, a reverse speed control mode is performed. Under this circumstance, the reverse motor torque limitation (Torque limit_motor) and the reverse regenerative torque limitation (Torque limit_generative) are set to the normal values, which are multiples of the rated torque (for example 120) (see the step S143). Consequently, the reverse rotation speed of the electric motor 11 is controlled to be maintained at the preset value, and the stored potential energy in the screw pump 2 is converted into the regenerative electrical energy.

Please refer to FIGS. 3A and 3B again. After step S14, the DC bus voltage $V_{bus}$ is limited to be larger than a second threshold value $V_{th2}$ by using the braking unit 5 and the braking resistor 6 to release the excess regenerative electrical energy (see the step S15). The second threshold value $V_{th2}$ is lower than the first threshold value $V_{th1}$. After step S15, the controlling unit 124 detects whether the electrical power from the power source 3 is restored or provided again (see the step S16).

In the step S16, if the controlling unit 124 detects that the electrical power from the power source 3 is restored or provided again during the backspin control period, the motor drive 12 drives the electric motor 11 to perform forward rotation and accelerate the rotation speed so as to control the screw pump 2 to pump the oil form the oil well immediately (see the step 17), and then the step S11 is repeatedly done. In the step S16, if the controlling unit 124 detects that the electrical power from the power source 3 is not restored, the level of the reverse regenerative torque $T_b$ is monitored (see the step S18). Then, the level of the reverse regenerative torque $T_b$ is compared with a torque preset value $T_{th}$ to detect whether the level of the reverse regenerative torque $T_b$ is smaller than the preset torque value $T_{th}$ (see the step S19). If the level of the reverse regenerative torque $T_b$ is smaller than the preset torque value $T_{th}$, the backspin action of the screw pump 2 is allowed to be stopped freely (see the step S20). If the level of the reverse regenerative torque $T_b$ is larger than the preset torque value $T_{th}$, the step S13 is repeatedly done.

Figure 5:
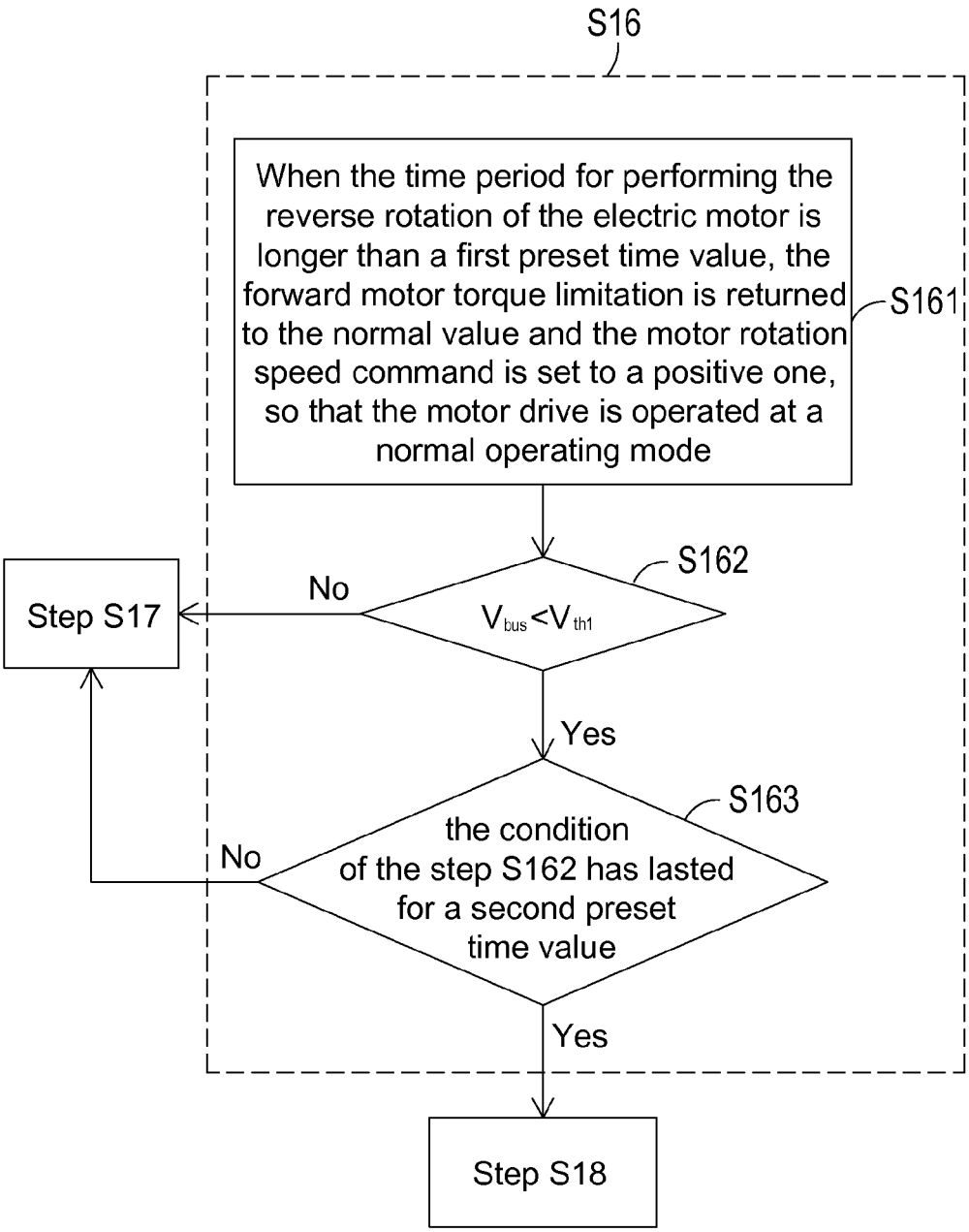
FIG. 5 is a schematic flowchart illustrating the sub-steps in step S16 of FIG. 3B.

FIG. 5 is a schematic flowchart illustrating the sub-steps in step S16 of FIG. 3B. Please refer to FIG. 5. When the controlling unit 124 of the motor drive 12 detects that the time period for performing the reverse rotation of the electric motor 11 is longer than a first preset time value and the forward motor torque limitation is returned to the normal value, so that the motor rotation speed command $W^*_r$ is set to a positive one, and the motor drive 12 is operated at a normal operating mode (see step S161). The normal value is a multiple of the rated torque (for example 120). Under this circumstance, the reverse rotation of the electric motor 11 is switched to the forward rotation. After the step S161, if the controlling unit 124 detects that the DC bus voltage $V_{bus}$ is lower than the first threshold value $V_{th1}$ again, the electrical power from the power source 3 cannot be maintained at the DC bus voltage $V_{bus}$ and the controlling unit 124 determines that the electrical power from the power source 3 is not restored (see step S162). If the controlling unit 124 detects that the condition of the step S162 has lasted for a second preset time value, the controlling unit 124 determines that the electrical power is lost for a long time period and the step S18 is performed.

From the above descriptions, the present invention provides a control method and a control system for controlling a screw pump in order to eliminate the effects of backspin when electrical power is lost. Electrical power interruption can be detected by the motor drive of the pump control system, and a backspin control of the screw pump is performed accordingly. When the electrical power is lost, the inventive control system can maintain the operations of the motor drive and the electric motor to control the backspin of the screw pump by using regenerated electrical power, which is converted from the stored potential energy released by the backspin action of the pump rod. Consequently, when electrical power is lost, the effects of backspin that occur in the conventional control system will be avoided. That is, the possibility of resulting in equipment destruction of the drive mechanism and other production equipment will be minimized, and the personal safety, environment cleanliness and the productivity of the screw pump will be enhanced. Moreover, when the electrical power is lost and the backspin of the screw pump occurs, the time period of stopping the screw pump can be shortened by using a braking unit and a braking resistor of a brake device to release the excess stored potential energy. When the electrical power is provided again during the backspin control period, the motor drive can drive the electric motor to control the screw pump to perform the positive displacement pumping action immediately. The present invention provides a system and method for controlling backspin of a screw pump when electrical power is lost so as to improve the productivity of the screw pump.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A control method for use with a control system to control a screw pump, the control system comprising an electric motor and a motor drive, the electric motor being synchronously rotated with the screw pump, the motor drive controlling an operation of the electric motor, the motor drive comprising a DC/AC converter for converting a DC bus voltage into a driving voltage so as to drive the electric motor, the DC bus voltage being obtained by converting an electrical power from a power source, the control method comprising steps of:

(a) monitoring the DC bus voltage;

(b) judging whether the DC bus voltage is smaller than a first threshold value, wherein if a judging result of the step (b) indicates that the DC bus voltage is smaller than the first threshold value, a step (c) is performed;

(c) allowing a potential energy which is due to an oil load on the screw pump and released by a backspin action to be converted into a regenerative electrical energy, and providing the regenerative electrical energy to the motor drive to maintain a normal operation of the motor drive;

(d) allowing the motor drive to drive the electric motor to control the backspin action of the screw pump according to a backspin torque limit strategy;

(e) limiting the DC bus voltage to be larger than a second threshold value;

(f) judging whether the electrical power from the power source is restored;

(g) if a judging result of the step (f) indicates that the electrical power from the power source is not restored, monitoring a level of a reverse regenerative torque;

(h) judging whether the level of the reverse regenerative torque is smaller than a preset torque value; and (i) if a judging result of the step (h) indicates that the level of the reverse regenerative torque is smaller than the preset torque value, allowing the backspin action of the screw pump to be stopped freely;

wherein the backspin torque limit strategy in the step (d) comprises:

(d1) setting a motor rotation speed command to a negative one, wherein when a rotation speed of the electric motor is positive, a forward motor torque limitation is set to zero and a forward regenerative torque limitation is set to a normal value;

(d2) when the rotation speed of the electric motor is negative and lower than a preset value, setting a reverse motor torque limitation to zero and setting a reverse regenerative torque limitation to the normal value;

(d3) when the rotation speed of the electric motor is negative and larger than the preset value, performing a reverse speed control mode and setting the reverse motor torque limitation and the reverse regenerative torque limitation to the normal values;

wherein the step (f) further comprises sub-steps of:

(f1) when the motor drive detects that a time period for performing the reverse rotation of the electric motor is longer than a first preset time value, the forward motor torque limitation is returned to the normal value, and the motor rotation speed command is set to a positive one, so that the motor drive is operated at a normal operating mode and a reverse rotation of the electric motor is switched to a forward rotation;

(f2) if the DC bus voltage is lower than the first threshold value after the electric motor is switched to the forward rotation, the motor drive judges that the electrical power from the power source is not restored; and (f3) if the DC bus voltage is lower than the first threshold value for a second preset time value and the motor drive judges that the electrical power from the power source is not restored, the step (g) is performed.

2. The control method according to claim 1, wherein the second threshold value is lower than the first threshold value.

3. The control method according to claim 1, wherein if the detecting result of the step (b) indicates that the DC bus voltage is not smaller than the first threshold value, the step (a) is repeatedly done.

4. The control method according to claim 1, wherein if the judging result of the step (f) indicates that the electrical power from the power source is restored, a step (j) is performed so that the electric motor is driven to perform forward rotation and accelerate the rotation speed, and the step (a) is repeatedly done.

5. The control method according to claim 1, wherein if the judging result of the step (h) indicates that the level of the reverse regenerative torque is not smaller than the preset torque value, the step (c) is repeatedly done.

6. The control method according to claim 1, wherein in the step (e), a brake device of the control system consumes a portion of the regenerative electrical energy, so that the DC bus voltage is limited to be larger than the second threshold value.

7. A control system for controlling a screw pump, the control system comprising:

an electric motor synchronously rotated with the screw pump; and a motor drive electrically connected with a power source and the electric motor, and configured to convert an electrical power from the power source and provide the converted electrical power to the electric motor, wherein the motor drive comprises:

a DC/AC converter electrically connected with the electric motor for converting a DC bus voltage into a driving voltage so as to drive the electric motor, wherein the DC bus voltage is obtained by converting the electrical power from the power source; and a controlling unit electrically connected with the DC/AC converter for controlling the DC/AC converter and monitoring the DC bus voltage, wherein if the electrical power from the power source is interrupted and the controlling unit judges that the DC bus voltage is smaller than a first threshold value, a potential energy due to an oil load on the screw pump and released by a backspin action is converted into a regenerative electrical energy to provide the motor drive, and the backspin action of the screw pump is controlled according to a backspin torque limit strategy, wherein the controlling unit comprises:

a speed observer electrically connected with the electric motor for estimating a rotation speed of a rotor of the electric motor, thereby generating a rotation speed estimation value;

a backspin torque limitation unit electrically connected with the speed observer, wherein the backspin torque limitation unit store the backspin torque limit strategy, and provides a torque limitation according to the rotation speed estimation value;

a speed control circuit electrically connected with the backspin torque limitation unit, wherein the speed control circuit provides a torque command according to a rotation speed command and the torque limitation;

a torque controller electrically connected with the speed control circuit for converting the torque command into a Q-axis current command;

a flux controller for generating a D-axis current command;

a current control circuit electrically connected with the torque controller and the flux controller, wherein according to the Q-axis current command and the D-axis current command, the current control circuit generates an alpha current command and a beta current command, respectively; and a pulse width modulation generator electrically connected with the current control circuit and the DC/AC converter, wherein according to the alpha current command and the beta current command, the pulse width modulation generator generates a pulse width modulation signal to control ON/OFF operations of at least one switching element of the DC/AC converter.

8. The control system according to claim 7, wherein the motor drive further comprises:

an AC/DC converter electrically connected with the power source for converting the electrical power from the power source into a DC voltage; and a DC link electrically connected with the AC/DC converter and the controlling unit, wherein after the DC voltage is stabilized and filtered by the DC link, the DC bus voltage is generated.

9. The control system according to claim 8, wherein the control system further comprises a brake device including a brake unit and a brake resistor, wherein the brake unit is electrically connected between the motor drive and the brake resistor for controlling the brake resistor to consume the regenerative electrical energy.

10. The control system according to claim 9, wherein according to the backspin torque limit strategy, a motor rotation speed command is set to a negative one, wherein when a rotation speed of the electric motor is positive, a forward motor torque limitation is set to zero and a forward regenerative torque limitation is set to a normal value, wherein when the rotation speed of the electric motor is negative and lower than a preset value, a reverse motor torque limitation is set to zero and a reverse regenerative torque limitation is set to the normal value, wherein when the rotation speed of the electric motor is negative and larger than the preset value, a reverse speed control mode is performed and the reverse motor torque limitation and the reverse regenerative torque limitation are set to the normal values.

11. The control system according to claim 9, wherein the control system implements a control method, and the control method comprises steps of:

(a) monitoring the DC bus voltage;

(b) judging whether the DC bus voltage is smaller than the first threshold value, wherein if a judging result of the step (b) indicates that the DC bus voltage is smaller than the first threshold value, a step (c) is performed;

(c) allowing the potential energy due to an oil load on the screw pump and released by the backspin action to be converted into the regenerative electrical energy, and providing the regenerative electrical energy to the motor drive to maintain a normal operation of the motor drive;

(d) allowing the motor drive to drive the electric motor to control the backspin action of the screw pump according to the backspin torque limit strategy;

(e) limiting the DC bus voltage to be larger than a second threshold value;

(f) judging whether the electrical power from the power source is restored;

(g) if a judging result of the step (f) indicates that the electrical power from the power source is not restored, monitoring a level of a reverse regenerative torque;

(h) judging whether the level of the reverse regenerative torque is smaller than a preset torque value; and (i) if a judging result of the step (h) indicates that the level of the reverse regenerative torque is smaller than the preset torque value, allowing the backspin action of the screw pump to be stopped freely.

* * * * *